United States Patent [19]

Kitayama et al.

[11] Patent Number: 4,535,042

[45] Date of Patent: Aug. 13, 1985

[54] ELECTROPHOTOGRAPHIC PHOTOSENSITIVE MEMBER WITH ELECTRON DONOR AND ACCEPTOR LAYERS

[76] Inventors: Hiroyuki Kitayama; Toyoko Kobayashi, both of c/o Canon Kabushiki Kaisha, 30-2, 3-chome, Shimomaruko, Ohta-ku, Tokyo, Japan

[21] Appl. No.: 581,902

[22] Filed: Feb. 21, 1984

[30] Foreign Application Priority Data

Feb. 24, 1983 [JP] Japan ..... 58-28480
Feb. 24, 1983 [JP] Japan ..... 58-28481

[51] Int. Cl.[3] ..... G03G 5/06

[52] U.S. Cl. ..... 430/56; 430/61; 430/58; 430/59; 430/81; 430/83; 430/900

[58] Field of Search ..... 430/56, 58, 59, 81, 430/83, 900, 61

[56] References Cited

U.S. PATENT DOCUMENTS

| | | | |
|---|---|---|---|
| 3,287,113 | 11/1966 | Hoegl | 430/900 X |
| 4,018,602 | 4/1977 | Chu | 430/900 X |
| 4,106,934 | 8/1978 | Turnblom | 430/900 X |
| 4,264,695 | 4/1981 | Kozima et al. | 430/900 X |
| 4,281,053 | 7/1981 | Tang | 430/900 X |

FOREIGN PATENT DOCUMENTS

| | | | |
|---|---|---|---|
| 47-29736 | 8/1972 | Japan | 430/900 |
| 55-9558 | 1/1980 | Japan | 430/900 |
| 1337226 | 11/1973 | United Kingdom | 430/58 |

*Primary Examiner*—Roland E. Martin

[57] ABSTRACT

An electrophotographic photosensitive member constructed with a layer comprising an electron acceptor and a layer comprising an electron donor, both layers being supported by an electrically conductive substrate with themselves superposed upon each other to form a thin layer of charge-transfer complex at the interface between the two layers.

9 Claims, 2 Drawing Figures

ELECTROPHOTOGRAPHIC PHOTOSENSITIVE MEMBER WITH ELECTRON DONOR AND ACCEPTOR LAYERS

BACKGROUND OF THE INVENTION

1. Field of the Invention

This invention relates to a laminate type of electrophotographic photosensitive member comprising a layer of an electron acceptor and a layer of an electron donor which are superposed upon each other and supported by an electrically conductive substrate. The invention also relates to a process for making this type of electrophotographic photosensitive member.

2. Description of the Prior Art

There is known a laminate type of electrophotographic photosensitive member comprising a charge generation layer and a charge transport layer which are superposed upon each other and supported by an electrically conductive substrate.

However, this laminate type of photosensitive member is still insufficient in sensitivity and has a drawback in that considerable variations are considerably observed an increase of the light portion potential and a drop of dark portion potential when it is repeatedly charged and exposed immediately after strong light irradiation thereof.

SUMMARY OF THE INVENTION

An object of the invention is to provide an electrophotographic photosensitive member free from the above-mentioned disadvantages and provide a process for making such photosensitive members.

Another object of the invention is to provide an electrophotographic photosensitive member which has an improved sensitivity and suppresses an increase of the light portion potential and a drop of dark portion potential when charged and exposed repeatedly immediately after being irradiated with high intensity light, and provide a process for making such photosensitive members.

The above objects of the invention is achieved with an electrophotographic photosensitive member constructed with a layer comprising an electron acceptor and a layer comprising an electron donor, both layers being supported by an electrically conductive substrate with themselves superposed upon each other to form a thin layer of charge-tranfer complex at the interface between the two layers.

DETAILED DESCRIPTION OF EMBODIMENTS OF THE INVENTION

Figure 1:
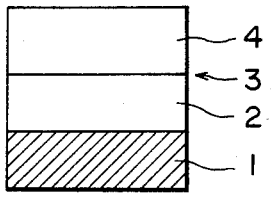
FIGS. 1 and 2 are cross-sectional views of embodiments of the electrophotographic photosensitive member according to the present invention.

The photosensitive member of the invention is characterized in that a layer comprising a high or low molecular electron acceptor (hereinafter this layer is referred to as an acceptor layer) and a layer comprising a high or low molecular electron donor (hereinafter this layer is referred to as a donor layer), supported by a conductive substrate, are superposed upon each other, thereby forming a thin layer of charge-transfer complex at the interface thereof to utilize this thin layer as a charge generation layer.

The electron acceptor in the present specification means any of a low molecular electron acceptor, a dispersion thereof in a polymer matrix, and a high molecular electron acceptor.

The electron donor in the present specification means any of a low molecular electron donor, a dispersion thereof in a polymer matrix, and a high molecular electron doner.

A possible cause of the insufficient sensitivity of the separate-function laminate type photosensitive member, of which the photosensitive layer comprises a charge generation layer and a charge transport layer, seems that the carriers generated by light exposure are trapped in the charge-generating material, so that the carriers (holes and electrons) cannot effectively move injected from the charge generation layer into the charge transport layer. Additionally, the low effectiveness of the carrier movement have significant influence on an increase of the light portion potential and a lowering of dark portion potential when the charging and exposing are repeated immediately after the irradiation with high intensity light.

The present inventors have found out the following fact: When a thin layer of a charge-transfer complex is formed at an interface between an acceptor layer and a donor layer by the interaction between the electron acceptor and electron donor and is utilized as a charge generation layer, holes and electrons produced by light exposure are not trapped in the thin layer and effectively move in the donor layer and acceptor layer, respectively, so that the sensitivity is enhanced and the variations in the light portion and dark portion potentials can be suppressed which are caused by repeating the charging and exposing immediately after the irradiation with high intensity light.

The charge-transfer complex, in the present specification, is an organic molecular complex DA constituted of an electron donor D and an electron acceptor A, wherein D includes a high molecular electron donor and a low molecular electron donor dispersed molecularly in a polymer matrix and A includes a low molecular electron acceptor, the same dispersed molecularly in a polymer matrix, and a high molecular electron acceptor. The stabilization energy for the charge-transfer complex DA is given by the transfer of some electrons from D to A. The formation of a charge-transfer complex can be readily ascertained by the spectroscopic observation of the larger transfer absorption band. Gernerally speaking, it is desirable to choose a compound as D having a low ionization potential Ip and a compound as A having a storing electron affinity $E_A$ and further a combination of A and A forming a state of high degree overlapping molecular alignment and solid structurally.

Materials used for making the laminate type electrophotographic photosensitive member of the invention are illustrated below. The low molecular electron acceptors include, e.g. 1,3,5-tricyanobenzene, m-dinitrobenzene,1,2,4,5-tetracyanobenzene, tetrachlorophthalic anhydride, maleic anhydride, 2,4,6-trinitrotoluene, 1,3,5-trinitrobenzene, p-benzoquinone, pyromellitic anhydride, chloro-p-benzoquinone, 1,2-dicarboxy-1,2-dicyanoethylene, 2,3-dichloro-p-benzoquinone, 2,5-dichloro-p-benzoquinone, 2,6-dichloro-p-benzoquinone, 2,4,7-trinitro-9-fluorenone, trichloro-p-benzoquinone, p-iodoanil, p-bromanil, p-chloranil, o-chloranil, o-bromanil, tetracyano-p-benzoquinone, tetracyano-p-quinodimethane, 2,3-dicyano-p-benzoquinone, 2,6-dinitro-p-benzoquinone, tetracyanoethylene, 2,3-dichloro- 5,6-dicyano-p-benzoquinone, and the like. These low molecular electron donors can be used also in the form of molecular dispersion in a polymer matrix. Polymers usable for the matrix include, e.g. polyarylate resin, polysulfone resin, polyamide resin, acrylic resin, acrylonitrile resin, methacrylic resin, vinyl chloride resin, vinly acetate resin, phenolic resin, epoxy resin, polyester resin, alkyd resin, polycarbonate resin, polyurethane resin, and the like, and further copolymers comprising two or more kinds of repeating units of these resins, e.g. styrenebutadiene copolymer, styrene-acrylonitrile copolymer, styrene-maleic acid copolymer, and the like.

The high molecular electron acceptors include, e.g. vinyl butyral resin, maleic acid resin, ketonic resin, and cellulose esters. These can be used singly or in combination of two or more.

The high molecular electron donors include, e.g. polystyrene, polymethylstyrene, polydimethylaminostyrene, polyvinlycarbazole, poly (carbazolylethyl vinyl ether ), poly (2-vinylpyridine), poly (4-vinylpyridine), poly (2-methyl-5-vinylpyridine), poly (naphthylmethyl glutamate), polyvinylnaphthalene, polyvinylanthracene, polyvinylpyrene, polyvinylphenylanthracence, and polyacenaphthalene.

The low molecular donative substances include, polycyclic aromatics, e.g. anthracene and pyrene; carbazole compounds, e.g. N-ethylcarbazole and N-isopropylcarbazole; hydrazones, e.g., p-diethylamino-o-chlorobenzaldehyde-N-phenyl-N-naphthylhydrazone, 9-ethylcarbazole-3-aldehyde-N-methyl-N-phenylhydrazone, 9-ethylcarbazole-3-aldehyde-N,N-diphenylhydrazone, 10-ethylcarbazole-3-aldehyde-N,N-diphenylhydrazone, 10-ethylphenoxazine-3-aldehyde-N,N-diphenylhydrazone, p-dithylaminobenzaldehyde-N,N-diphenylhydrazone, p-diethylaminobenzaldehyde-N-α-naphthyl-N-phenylhydrazone, p-pyrrolidinylbenzaldehyde-N,N-diphenylhydrazone, 1,3,3-trimethylindolenine-ω-aldehyde-N,N-diphenylhydrazone, and p-diethylaminobenzaldehyde-3-methylbenzothiazolinone -2-hydrazone; 2,5-bis (p-diethylaminophenyl)-1,3,4-oxadiazole; pyrazoline compounds, e.g. 1-phenyl-3-(p-diethylaminostyryl)-5-(p-diethylaminophenyl) pyrazoline, 1-[quinolyl (2)]-3-(p-diethylaminostyryl)-5-(p-diethylaminophenyl) pyrazoline, 1-[pyridyl (2)]-3-(p-diethylaminostyryl)-5-(p-diethylaminophenyl) pyrazoline, 1-[6-methoxypyridyl (2)]-3-(p-diethylamino styryl)-5-(p-diethylaminophenyl) pyrazoline, 1-[pyridyl (3)]-3-(p-diethylaminostyryl)-5-(p-diethylamintophenyl) pyrazoline, 1-(lepidyl (2)]-3-(p-diethylaminostyryl)-5-(p-diethylaminophenyl) pyrazoline, 1-[pyridyl (2)]-3-(p-diethylaminostyryl)-4-methyl-5-(p-diethylaminophenyl) pyrazoline, 1-pyridyl (2)]-3-(α-methyl-p-diethylaminostyryl)-5-(p-diethylaminophenyl) pyrazoline, 1-phenyl-3-(p-diethylaminostyryl)-4-methyl-5-(p-diethylaminophenyl) pyrazoline, 1-phenyl-3-(α-benzyl-p-diethylaminostyryl)-5-(p-diethylaminophenyl) pyrazoline, and spiropyrazoline; oxazole compounds, e.g. 2-(p-diethylaminostyryl)-6-diethylaminobenzoxazole and 2-(p-diethylaminophenyl)-4-(p-dimethylaminophenyl -5-(2-chlorophenyl)oxazole; thiazole compounds, e.g. 2-(p-diethylaminostyryl)-6-diethylaminobenzothiazole; triarylmethanes, e.g. bis (4-diethylamino-2-methylphenyl) phenylmethane; polyarylalkanes, e.g. 1,1-bis (4-N,N-diethylamino-2-methylphenyl) heptane and 1,1,2,2-tetrakis (4-N,N-dimethylamino-2-methylphenyl) ethane; triphenylamines; and the like.

These low molecular electron donors can be used singly or in combination of two or more.

Suitable resins for the dispersion medium of the above low molecular electron donor include insulating resins, e.g. acrylic resin, polyarylate, polyester, polycarbonate, polystyrene, acrylonitrile-styrene copolymer, acrylonitrile- butadiene copolymer, poly (vinyl butyral) poly(vinyl formal), polysulfone, polyacrylamide, polyamide, and chlorinated rubber; and polymers, e.g. polystyrene, polymethylstyrene, polydimethylaminostyrene, polyvinylcarbazole, poly (carbazolylethyl vinyl ether), poly (2-vinylpyridine), poly (4-vinylpyridine), poly(2-methyl-5-vinylpyridine), poly (naphthylmethyl glutamate), polyvinylnaphthalene, polyvinylanthrance, polyvinylpyrene, polyvinylphenyanthracene, and polyacenaphthalene.

FIG. 1 is a cross-sectional view of a laminate type photosensitive member coated on a conduction layer, of the invention. In this photosensitive member, an acceptor layer 2 communicates electrically with a donor layer 4 and a charge-transfer complex is formed at the interface 3 between these layers. When the photosensitive member corona-charged negatively is exposed to light, the holes and electrons of charge carriers generated at the interface 3 are effectively injected into the layers 4 and 2, respectively.

Figure 2:
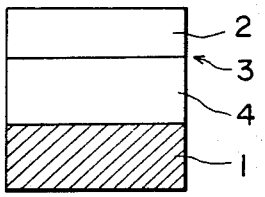

FIG. 2 is a cross-sectional view of another laminate type photosensitive member of the invention. This photosensitive member is opposed to the photosensitive member of FIG. 1 in the positional relation between the layers 4 and 2 and is to be operated with positive corona charging.

The photosensitive laminate layer comprising the donor layer 4 and acceptor layer 2 is formed on the conductive substrate 1. Materials usable for such a substrate include; sheets or the like of metals, conductive in themselves, e.g. aluminum, aluminum alloy, copper, zinc, staintell steel, vanadium, molybdenum, chromium, titanium, nickel, indium, gold, and platinum; those of plastics, e.g. polyethylene, polypropylene, poly (vinyl chloride), poly (ethylene terephthalate), acrylic resin, and polyfluoroethylene, which have a conductive coating layer formed by vacuum deposition from aluminum, aluminum alloy, indium oxide, tin oxide, indium oxide-tin oxide alloy, or the like; those the plastics coated with conductive particles, e.g. carbon black, silver particles, or the like, in combination with a suitable binder; those of plastics or paper impregnated with conductive particles; and those of plastics coated with a conductive polymer.

A subbing layer which functions as a barrier and as an adhesive can be laid between the conductive substrate and the photosensitive laminate layer. The subbing layer can be formed with, e.g. casein, poly (vinyl alcohol), nitrocellulose, ethylene-acrylic acid copolymer, polyamide (nylon 6, nylon 66, nylon 610, copolymerized nylon, alkoxymethylated nylon, or the like), polyurethane, gelatin, or aluminum oxide.

Suitable thickness of the subbing layer ranges from 0.1 to 5μ, particularly from 0.5 to 3μ.

Organic solvents for use in the formation of subbing, donor, and acceptor layers include; alcohols, e.g. methanol, ethanol, and isopropanol; ketones, e.g. acetone, methyl ethyl ketone, and cyclohexanone; amides, e.g. N,N-dimethylformamide and N,N-dimethylacetamide; sulfoxides, e.g. dimethylsulfoxide; ethers, e.g. tetrahydrofuran, dioxane, and ethylene glycol monomethyl ether; esters, e.g. methyl acetate and ethyl acetate; halogenated aliphatic hydrocarbons, e.g. chloroform, methylene chloride, dichloroethylene, carbon tetrachloride, and trichloroethylene; and aromatic hydrocarbons or those halogenated, e.g. benzene toluene, xylene, ligroin, monochlorobenzene, and dichlorobenzene. It is a matter of course that the organic solvent to be used in the formation of each layer varies depending upon the kinds of component materials of this layer and also of the subbing layer; for instance, when a donor layer or acceptor layer is formed on a subbing layer, the solvent to be used is desired to select from those which do not dissolve the subbing layer.

A theme on which particular ingenuity was exerted for accomplishing the invention is the method for forming the charge-transfer complex layer as thin as possible at the interface between the donor layer and acceptor layer. The effective formation of a thin layer of charge-transfer complex at the interface between the donor layer and the acceptor layer has led to success in enhancing the sensitivity and suppressing the potential variations which occur when the charging and exposing are repeated immediately after the irradiation with high intensity light.

Details of the method are as follows: A first coating layer, i.e. donor or acceptor layer is formed on a conductive substrate by the coating method which will be mentioned below, and is dried. Then, a second coating layer is formed by coating a solution of either an electron acceptor when the first coating layer is a donor layer or an electron donor when the first coating layer is an acceptor layer. In this case, the solvent to be used for the second coating layer needs to be selected from the solvents which dissolve the electron donor or electron acceptor of the first coating layer. At the moment of applying the second coating layer composition using such a solvent, a color change can be observed between the first and second coating layers and a thin layer of charge-transfer complex is immediately formed. The formation of charge-transfer complex by the interaction between an electron donor and an electron acceptor can be confirmed by forming a film from a coating mixture of both the materials and observing a storing characteristic absorption band due to charge transfer in the visible light region of the absorption specrum of the film. Sometimes, depending upon the kinds of electron donor and electron acceptor chosen, such a sufficiently strong absorption band does not appear; when such materials were used to form a photosensitive laminate, its sensitivity, as a natural result, was unsatifactory.

The coating to form these layers can be carried out by various coating methods such as the dip coating, spray coating, spinner coating, bead coating, Meyer bar coating, blade coating, roller coating, and curtain coating methods. Preferably, the coating is dried by heating after its set to touch. The drying with heat can be carried out at temperatures of 30°-200° C. for periods of 5 minutes-2 hours with or without blowing air.

The electrophotographic photosensitive member according to the invention can be used not only in electrophotographic copying machines but also over a wide field of electrophotographic applications such as those to laser printers, CRT printers, and electrophotographic systems for making printing plates.

According to the invention, it is possible to provide a high-sensitivity electrophotographic photosensitive member which shows limited variations in the light portion and dark portion potentials when the charging and exposing are repeated immediately after the irradiation with high intensity light.

The invention is illustrated further with reference to the following Examples:

EXAMPLE 1

A polycarbonate resin (3g) (tradename : Teijin Paulite L-1250, made by Teijin Co., Ltd.) and 2,4,7-trinitro-9-fluorenone (3g) were dissolved in tetrahydrofuran (30 ml). This solution was applied to an aluminum sheet with a Meyer bar to form an acceptor layer of 8μ in dry thickness.

Then, a solution of a poly (N-vinylcarbazole) (3g) (tradename : Lubican M-170, made by BASF) in tetrahydrofuran (30 ml) (concentration of poly(N-vinylcarbazole): 10 wt %) was applied to the acceptor layer with a Meyer bar to form donor layer of 8μ in dry thickness. Thus, a photosensitive member (Sample 1) was prepared which comprised a photosensitive laminate of acceptor and donor layers.

On the other hand, a separate function type of photosensitive member comprising a charge generation layer and a charge transport layer both laminated in that order on a conductive substrate was prepared as a comparative sample in the following manner:

A disazo pigment (4.1 g) of the formula

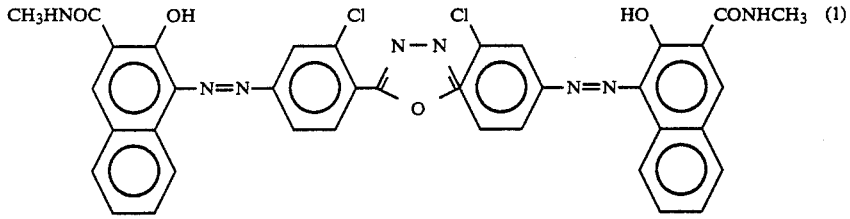

(1)

was placed in a 50-ml glass bottle, cyclohexanone (18.1 g) and glass beads (20 ml) were added thereto, and the mixture was ground in a disperser for 4 hours. To the resulting dispersion was added a 9.1 wt % solution (4.4 g) of poly (vinyl butyral) (tradename: BM-2, made by Sekisui Chemical Co., Ltd.), as a binder, in a methyl ethyl ketone-cyclohexanone (weight ratio 1:1) mixture, and the grinding in the disperser was further conducted for 2 hours. The resulting dispersion was applied to an aluminum sheet with a Meyer bar to form a charge generation layer of 0.2μ in dry thickness.

An 1:1 wt. ratio mixture of a hydrazone of the formula

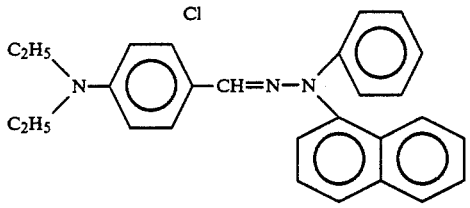

(2)

(p-diethylamino-o-chlorobenzaldhyde-N-phenyl-N-α-naphthylhydrazone) and a binder resin styrene-acryle copolymer (tradename:MS-200, made by shinnihon-Seitetsukagaku Co., Ltd.) was dissolved in monochlorobenzene to form a solution of 20 wt. % concentration. This solution was applied to the charge generation layer with a Meyer bar to form a charge transport layer of 12μ in dry thickness. The thus prepared photosensitive member was designated as Comparative Sample 1.

The two types of photosensitive member were coronacharged in the dynamic fashion using an electrostatic copying paper testing machine (Model SP-428, made by Kawaguchi Denki Co., Ltd.), then were retained for 1 second in the dark, and exposed to light for 4 seconds at an intensity of 5 lux, to examine charge bearing characteristics thereof.

The charge bearing characteristics were determined by measurement of exposure quantity (E1/6) for reducing the surface potential ($V_1$) of the sample retained for 1 second in the dark after charging to a sixth part of $V_1$.

For indicating the degree of variations in the light portion and dark portion potentials after repeated operations of photosensitive members, the sample subjected once to the above test was irradiated with a fluorescent lamp for 3 seconds at an intensity of 6001ux, allowed to stand for 1 minute in the dark, and subjected again to the same charging and exposing test as the above, to determine the difference ($\Delta V_1$) between the first and second test values of $V_1$. The larger value of $\Delta V_1$ indicates the greater variations of the light portion and dark portion potentials in repeated operations of the photosensitive member tested.

Results of the above tests on Sample 1 and Comparative Sample 1 were as follows:

| Photosensitive member | $V_1$ (V) | E1/6 (lux.sec) | $\Delta V_1$ (V) |
|---|---|---|---|
| Sample 1 | −600 | 4.7 | −30 |
| Comparative Sample 1 | −600 | 7.5 | −95 |

From the above results, it proves that Sample 1 having a layer structure of conductive substrate-acceptor layer-donor layer has a high sensitivity and can be repeatedly operated with limited variations of the potentials after strong light exposure, while Comparative Sample 1 having a layer structure of conductive substrate-charge generation layer-charge transport layer is inferior in these characteristics. These results on Comparative Sample 1 indicates that a great number of traps are present in the charge generation layer and the carriers generated by light irradiation cannot move effectively.

EXAMPLE 2

An aluminum sheet was heated to 180° C. on a hot plate, and crystalline 2,4,7-trinitro-9-fluorenone (1 g) was melted on the aluminum sheet. Immediately thereafter, the melt was spread to a definite thickness with a Meyer bar heated to 180° C. Then, the aluminum sheet was removed from the hot plate and rapidly cooled by leaving at room temperature. Thus, a transparent acceptor layer 1μ thick of amorphous 2,4,7-trinitro-9-fluorenone was formed on the aluminum sheet.

A donor layer 8μ thick of poly (N-vinylcarbazole) was laminated on the acceptor layer and the thus prepared photosensitive member (designated as Sample 2) was tested for charge bearing characteristics, in the same manner as in Example 1. Results thereof were as follows:

$V_1 = -600$ V, E1/6=4.5 lux.sec, $\Delta V_1 = -3.5$ V

EXAMPLE 3

A methanolic solution of a polyamide mixture [An 1:1 wt. ratio mixture of CM-8000 (tradename, made by Toray Industries Inc.) and Toresin (tradename, made by Teikoku Kagaku Co., Ltd.)] (2 wt. % concentration) was applied to an aluminum sheet with a Meyer bar to form a subbing layer of 0.5μ in dry thickness.

Then, a coating solution of a polystyrene (3 g) (tradename:Dialex HF 55, made by Mitsubishi-Monsanto Co., Ltd.) in monochlorobenzene (3 g) (the concentration of polystyrene: 10 wt. %) was applied to the subbing layer with a Meyer bar to form a donor layer of 8μ in dry thickness.

A polycarbonate resin (3 g) (tradename:Teijin Panlite L-1250, made by Teijin Co., Ltd.) and maleic anhydride (3 g) were dissolved in tetrahydrofuran (30 ml). This coating liquid was applied to the donor layer with a Meyer bar to form an acceptor layer of 8μ in dry thickness.

The 3-ply laminate type of photosensitive member thus prepared (Sample 3) was tested for charge bearing characteristics in the same manner as in Example 1 but with positive charging. Results thereof were as follows:

$V_1 = +590$ V, E1/6=4.8 lux.sec, $\Delta V_1 = -45$ V

EXAMPLE 4

A polycarbonate resin (3 g) (tradename: Teijin Panlite L-1250, made by Teijin Co., Ltd.) and 2,4,7-trinitro-9-fluorenone (3 g) were dissolved in tetrahydrofuran (30 ml). The resulting coating liquid was applied to an aluminum sheet with a Meyer bar to form an acceptor layer of 8μ in dry thickness.

An 1:1 wt. ratio mixture of a hydrazone of the formula

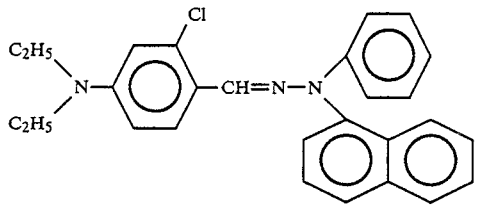

(2)

(p-diethylamino-o-chlorobenzaldehyde-N-phenyl-N-α-naphthyl hydrazone) and a binder resin styrane-acryle copolymer (tradename:MS-200, made by shinnihon-Seitetsukagaku Co., Ltd.) was dissolved in monochlorobenzene to form a solution of 20 wt. % concentration. The resulting coating liquid was applied to the acceptor layer with a Meyer bar to form a donor layer of 12μ in dry thickness.

The 2-ply laminate type of photosensitive member thus prepared was tested for charge bearing characteristics in the same manner as in Example 1. Results thereof were as follows:

$V_1 = -600$ V, E1/6=4.4 lux.sec, $\Delta V_1 = -30$ V

From these results, it proves that Sample 4 having a layer structure of conductive substrate-acceptor layer-donor layer has a high sensitivity and can be repeatedly operated with limited variations of the potentials after strong light exposure.

EXAMPLE 5

An aluminum sheet was heated to 180° C. on a hot plate, and crystalline 2,4,7-trinitro-9-fluorenone (1 g) was melted on the aluminum sheet. Immediately thereafter, the melt was spread to a definite thickness with a Meyer bar heated to 180° C. Then, the aluminum sheet was removed from the hot plate and rapidly cooled by leaving at room temperature. Thus, a transparent acceptor layer 1μ thick of amorphous 2,4,7-trinitro-9-fluorenone was formed on the aluminum sheet.

A donor layer 12μ thick of the hydrazone of formula (1) was laminated on the acceptor layer in the same manner as in Example 4.

The thus prepared photosensitive member (Sample 5) was tested for charge bearing characteristics in the same manner as in Example 1. Results thereof were as follows:

$V_1 = -600$ v, $E1/6 = 4.4$ lux.sec, $\Delta V_1 = -35$ V

EXAMPLE 6

A methanolic solution of a polyamide mixture [An 1:1 wt. ratio mixture of CM-8000 (tradename, made by Toray industries Inc.) and Toresin (tradename, made by Teikoku Kagaku Co., Ltd.)] (20 wt. % concentration) was applied to an aluminum sheet with a Meyer bar to form a subbing layer of 0.5μ in dry thickness.

An 1:1 wt. ratio mixture of a hydrazone of the formula (3)

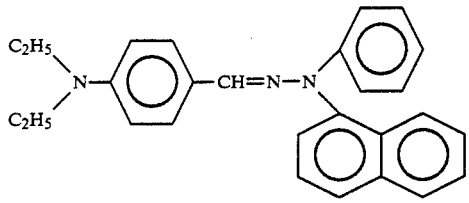

(p-diethylaminobenzaldehyde-N-phenyl-N-α-naphtylhydrazone) and a binder resin styrene-acryle copolymer (tradename: MS-200, made by Shinnihon Seitetsukagaku Co., Ltd.) was dissolved in monochlorobenzene to form a solution of 20 wt. % concentration. This solution was applied to the subbing layer with a Meyer bar to form a donor layer of 12μ in dry thickness.

A polycarbonate resin (3 g) (tradename:Teijin Panlite L-1250, made by Teijin Co., Ltd) and maleic anhydride (3 g) were dissolved in tetrahydrofuran (30 ml). The resulting solution was applied to the donor layer with a Meyer bar to form an acceptor layer of 8μ in dry thickness.

The 3-ply laminate type of photosensitive member thus prepared (Sample 6) was tested for charge bearing characteristics in the same manner as in Example 1 but with positive charging. Results thereof were as follows:

$V_1 = +590$ V, $E1/6 = 3.8$ lux.sec, $\Delta V_1 = -20$ V

What we claim is:

1. An electrophotographic photosensititve member constructed with a layer comprising a low molecular electron acceptor and a resin, and a layer comprising a low molecular hydrazone compound electron donor, and a resin both layers being supported by an electrically conductive substrate with themselves superposed upon each other to form a thin layer of charge transfer complex at the interface between the two layers.

2. The electrophotographic photosensitive member of claim 1, wherein the low molecular electron acceptor is at least one compound selected from the group consisting of 1,3,5-tricyanobenzene, m-dinitrobenzene, 1,2,4,5-tetracyanobenzene, tetrachlorophthalic anhydride, maleic anhydride, 2,4,6-trinitrotoluene, 1,3,5-trinitrobenzene, p-benzoquinone, pyromellitic anhydride, chloro-p-benzoquinone, 1,2-dicarboxy-1,2-dicyanoethylene, 2,3-dichloro-p-benzoquinone, 2,5-dichloro-p-benzoquinone, 2,6-dichloro-p-benzoquinone, 2,4,7-trinitro-9-fluorenone, trichloro-p-benzoquinone, p-idoanil, p-bromanil, p-chloranil, o-chloranil, o-bromanil, tetracyano-p-benzoquinone, tetracyano-p-quinodimethane, 2,3-dicyano-p-behnzoquinone, 2,6-dinitro-p-benzoquinone, tetracyanoethylane, and 2,3-dichloro-5,6-dicyano-p-benzoquinone.

3. The electrophotographic photosensitive member of claim 1, wherein the low molecular electron donor is at least one hydrazone compound selected from the group consisting of p-diethylaminobenzaldehyde-N,N-diphenylhydrazone, p-diethylaminobenzaldehyde-N-phenyl-N-α-naphthylhydrazone, p-diethylamino-chlorobezaldehyde-N-phenyl-N-naphthylhydrazone, 9-ethylcarbazole-3-aldehyde-N-methyl-N-phenylhydrazone, 9-ethylcarbazole-3-aldehyde-N,N-diphenylhydrazone, 10-ethylcabazole-3-aldehyde-N,N-diphenylhydrazone, 10-ethylphenoxazine-3-aldehyde-N,N-diphenylhydrazone, p-pyrrolidinylbenzaldehyde-N,N-diphenylhydrazone, 1,3,3,-trimethylindolenine-ω-aldehyde-N,N-diphenylhydrazone, and p-diethylaminobenzaldehyde-3-methylbenzothiazolinone -2-hydrazone.

4. The electrophotographic photosensitive member of claim 1, wherein the layer comprising an electron acceptor is laid on the upper side of the layer comprising an electron donor.

5. The electrophotographic photosensitive member of claim 4, wherein a subbing layer is laid between the conductive substate and the layer comprising an electron donor.

6. The electrophotographic photosensitive member of claim 1, wherein the layer comprising an electron donor is laid on the upper side of the layer comprising an electron acceptor.

7. The electrophotographic photosensitive member of claim 6, wherein a subbing layer is laid between the conductive substrate and the layer comprising an electron acceptor.

8. An electrophotographic photosensitive member according to claim 1, wherein said low molecular electron acceptor is a fluorenone compound.

9. An electrophotographic photosensitive member according to claim 1, wherein said low molecular electron acceptor is maleic anhydride.

* * * * *

UNITED STATES PATENT AND TRADEMARK OFFICE

CERTIFICATE OF CORRECTION

PATENT NO. : 4,535,042

DATED : August 13, 1985

INVENTOR(S) : HIROYUKI KITAYAMA, ET AL.

It is certified that error appears in the above-identified patent and that said Letters Patent is hereby corrected as shown below:

COLUMN 1

Lines 23-24, "considerably observed an" should read --observed, i.e., an--.
Line 41, "is" should read --are--.

COLUMN 2

Line 10, "seems" should read --seems to be--.
Line 13, "injected" should be deleted.
Line 16, "have" should read --has--.
Line 47, "Gernerally" should read --Generally--.

COLUMN 3

Line 7, "vinly" should read --vinyl--.
Line 23, "polyvinylphenylanthracence," should read --polyvinylphenylanthracene,--.
Line 52, "1-pyridyl(2)]-3" should read --1-[pyridyl (2)]-3--.

COLUMN 4

Line 12, "polyvinylanthrance" should read --polyvinylanthracene--.
Line 13, "polyvinylphenyanthracene" should read --polyvinylphenylanthracene--.
Line 36, "staintell steel," should read --stainless steel--.
Line 43, "those the plastics" should read --those plastics--.

UNITED STATES PATENT AND TRADEMARK OFFICE

CERTIFICATE OF CORRECTION

PATENT NO. : 4,535,042

DATED : August 13, 1985

INVENTOR(S) : HIROYUKI KITAYAMA, ET AL.

It is certified that error appears in the above-identified patent and that said Letters Patent is hereby corrected as shown below:

COLUMN 5

Line 52, "specrum" should read --spectrum--.

COLUMN 7

Line 1, "chlorobenzaldhyde" should read --chlorobenzaldehyde--.
Line 3, "shinnihon" should read --Shinnihon--.
Line 24, "600lux," should read --600 lux,--.

COLUMN 8

Line 55, "styrane-" should read --styrene- --.
Line 56, "shinnihon" should read --Shinnihon--.

COLUMN 9

Line 31, "industries" should read --Industries--.

COLUMN 10

Lines 7-8, "donor, and a resin" should read --donor and a resin--.

UNITED STATES PATENT AND TRADEMARK OFFICE

CERTIFICATE OF CORRECTION

PATENT NO. : 4,535,042

DATED : August 13, 1985

INVENTOR(S) : HIROYUKI KITAYAMA, ET AL.

It is certified that error appears in the above-identified patent and that said Letters Patent is hereby corrected as shown below:

COLUMN 10

Line 23, "p-idoanile," should read --p-iodoanile,--.
Line 26, "tetracyanoethylane," should read --tetracyanoethylene,--
Line 34, "chlorobezaldehyde" should read --chlorobenzaldehyde--.
Line 49, "substate" should read --substrate--.

Signed and Sealed this

Seventeenth Day of November, 1987

*Attest:*

DONALD J. QUIGG

*Attesting Officer*

*Commissioner of Patents and Trademarks*